US006062389A

United States Patent [19]

Kent

[11] Patent Number: 6,062,389

[45] Date of Patent: May 16, 2000

[54] DUAL BUCKET ASSEMBLY

[75] Inventor: David Kent, Lake Elsinore, Calif.

[73] Assignee: Kenmont, LLC, Mission Viejo, Calif.

[21] Appl. No.: 09/095,693

[22] Filed: Jun. 10, 1998

[51] Int. Cl.[7] ..... B65D 21/00

[52] U.S. Cl. ..... 206/518; 15/257.05; 15/257.06; 220/23.6; 220/555; 220/764; 220/765; D32/53.1

[58] Field of Search ..... 15/257.05, 257.06; 206/518, 515; D32/53, 53.1; 220/23.6, 505, 555, 763, 764, 765, 904

[56] References Cited

U.S. PATENT DOCUMENTS

| | | | |
|---|---|---|---|
| D. 73,649 | 10/1927 | Eiffe | D32/53 |
| D. 212,831 | 11/1968 | Koch . | |
| D. 353,241 | 12/1994 | Breen . | |
| 685,901 | 11/1901 | Baker | 220/764 |
| 1,517,164 | 11/1924 | Lear . | |
| 1,883,823 | 10/1932 | Renshaw | 220/764 |
| 1,997,362 | 4/1935 | Davis et al. . | |
| 2,321,981 | 6/1943 | Bowers . | |
| 2,470,432 | 5/1949 | Cusick . | |
| 2,705,334 | 4/1955 | Farrow | 220/505 X |
| 2,712,668 | 7/1955 | Thiele . | |
| 2,785,826 | 3/1957 | Mappes . | |
| 2,896,809 | 7/1959 | Metzger et al. | 220/23.6 X |
| 3,829,926 | 8/1974 | Salladay . | |
| 4,319,761 | 3/1982 | Wells . | |
| 4,706,918 | 11/1987 | Wilson | 15/257.06 X |
| 5,086,917 | 2/1992 | Dziersk et al. | 220/904 X |
| 5,199,571 | 4/1993 | Wolff et al. . | |
| 5,400,916 | 3/1995 | Weber . | |
| 5,472,111 | 12/1995 | Renfrew | 15/257.06 X |
| 5,641,087 | 6/1997 | Moffitt . | |

OTHER PUBLICATIONS

1998 Rubbermaid Brute Buckets, 1998 Catalog p. 42.

*Primary Examiner*—Allan N. Shoap
*Assistant Examiner*—Joe Merek
*Attorney, Agent, or Firm*—Victor Castellucci; Calif Tervo

[57] ABSTRACT

A dual bucket assembly (10) comprises a dual bucket (20) including first and second containers (30,50) adapted for holding liquid, a connecting member (70) and a bail (80). Each container includes a peripheral wall (31,51) having an upper end (32,52) having a top edge (33,53), a proximal portion (34,54) adjacent the other container and a non-proximal portion (37,57). Connecting member (70) rigidly connects in a spaced apart relationship upper ends (32,52) of peripheral walls (31,51). Peripheral walls (31,51) are downwardly inwardly sloping such that a plurality of dual buckets (20) are nestable. The top edge (33,53) of each non-proximal portion (37,57) is smoothly arcuate. Peripheral walls (31,51) and connecting member (70) are adapted for simultaneously pouring liquid contents from both containers (30,50) into separate storage vessels. A leveling device (90), such as a bail detent mechanism (91), selectively secures proximal end (81) of bail (80) such that the position of bail distal end (82) is selectively maintained substantially above the center of gravity (12) of dual bucket assembly (10) when assembly (10) is freely hung from bail distal end (82).

14 Claims, 4 Drawing Sheets

FIG. 3
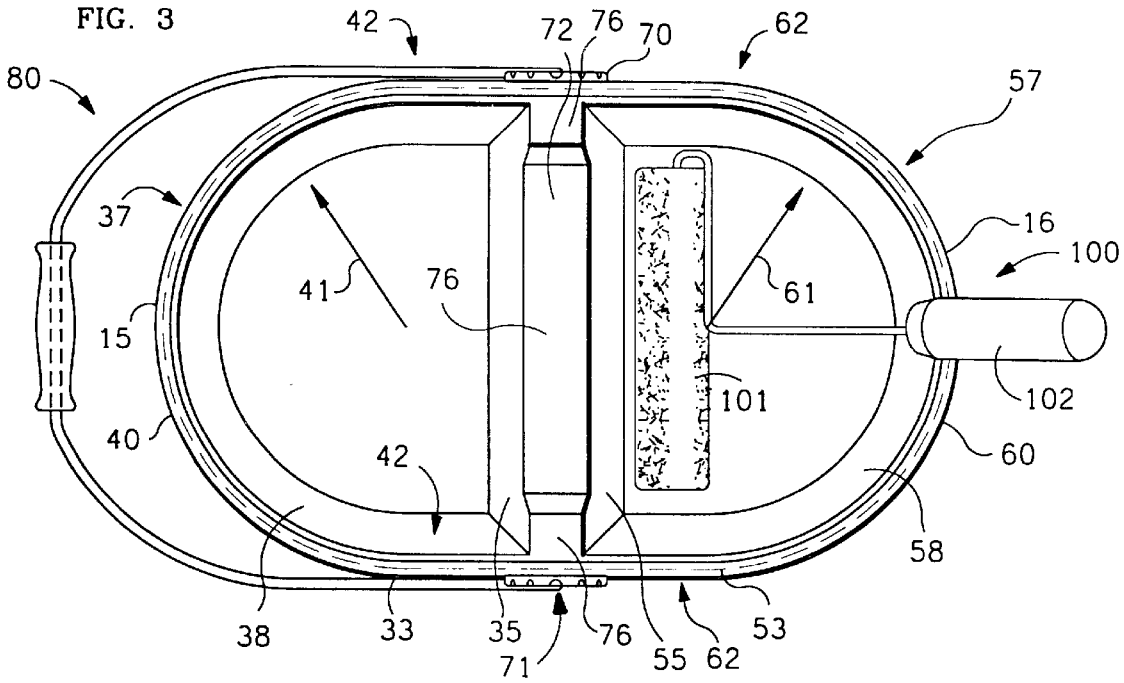
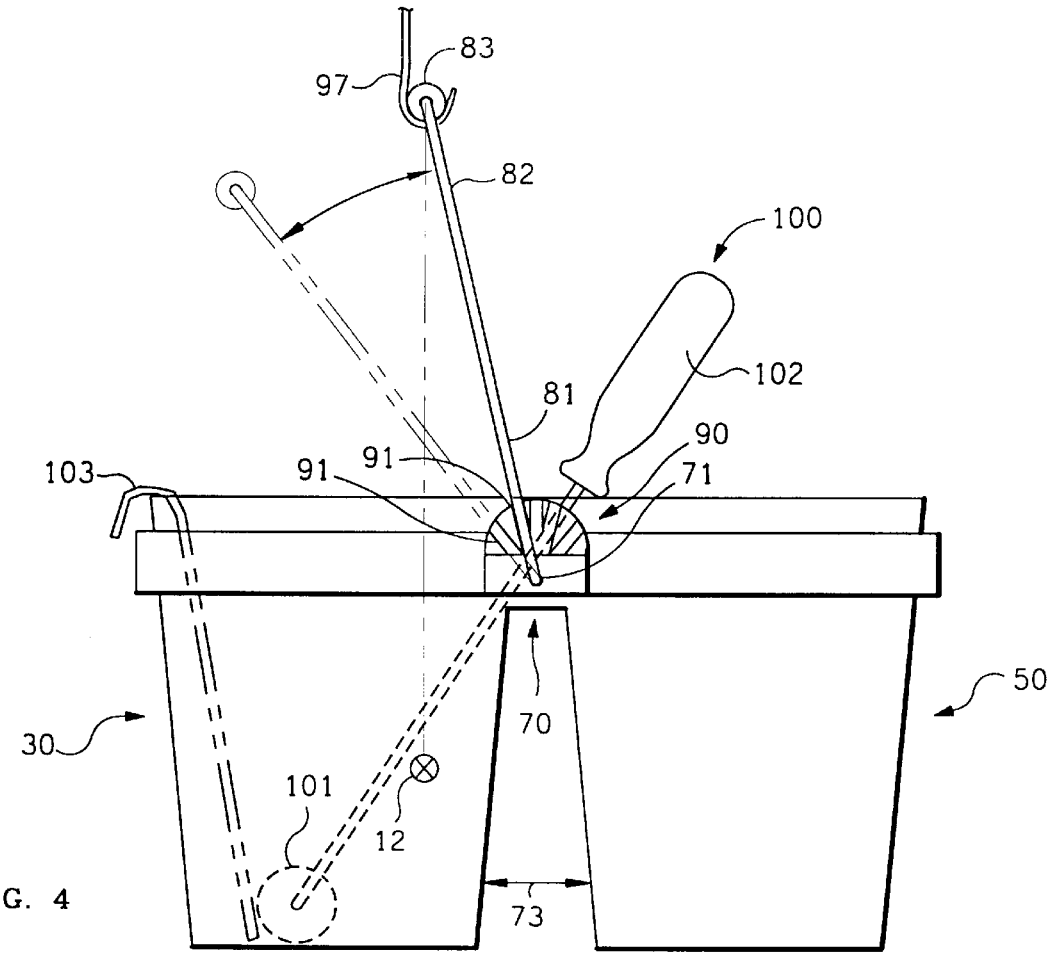
FIG. 4

DUAL BUCKET ASSEMBLY

FIELD OF THE INVENTION

This invention relates to a dual bucket assembly, such as for painting, and more specifically to a dual bucket assembly that is nestable and includes a leveling mechanism.

BACKGROUND OF THE INVENTION

It is often desirable to have two liquids available when performing certain tasks. For example, when painting, it is a great time saver to have available simultaneously both wall and trim paint. The paints may be of different colors and/or of different types, e.g. water based and oil based.

It is often desirable, particularly when painting, to pour simultaneously the contents out of both buckets into different storage containers.

It is desirable to work from a level bucket. Often the center of gravity of a dual bucket is not centered such that the dual bucket cannot be carried or hung in a level position. Therefore, it is desirable to have means for leveling a dual bucket assembly.

For storage or shipping purposes, it is desirable that dual bucket assemblies are nestable.

The various dual buckets that have been proposed in the prior art do not satisfy these needs.

SUMMARY OF THE INVENTION

This invention is a dual bucket assembly and it generally comprises a dual bucket including a first container adapted for holding liquid and a second container adapted for holding liquid connected by a connecting member, and a bail.

In an exemplary embodiment, the first container includes a peripheral wall having an upper end having a top edge. The peripheral wall includes a proximal portion adjacent the second container. The proximal portion has an inner face and an outer face. A non-proximal portion has an inner face and an outer face. The second container is similarly constructed.

A connecting member is attached to upper ends of peripheral walls and rigidly connects in a spaced apart relationship the upper end of the peripheral walls of the containers.

The peripheral walls are downwardly inwardly sloping such that a plurality of the dual buckets are nestable. The top edge of each non-proximal portion of the peripheral walls is smoothly arcuate.

The bail includes a distal end and a proximal end pivotally connected to the connecting member.

The peripheral walls and connecting member are adapted for simultaneously pouring liquid contents from both of the containers into separate storage vessels.

A leveling device, such as a bail detent mechanism, selectively secures the proximal end of the bail such that the position of the distal end of the bail is selectively maintained substantially above the center of gravity of the dual bucket assembly when the assembly is freely hung from the distal end of the bail.

Other features and many attendant advantages of the invention will become more apparent upon a reading of the following detailed description together with the drawings in which like reference numerals refer to like parts throughout.

BRIEF DESCRIPTION OF THE DRAWINGS

FIG. 3 is a top plan view of the dual bucket assembly of FIG. 1 further including a paint roller in a typical position.

FIG. 4 is a front elevation view of the assembly of FIG. 1 further including a paint roller and grid and showing a preferred embodiment of the leveling means of the invention in use.

DETAILED DESCRIPTION OF THE INVENTION

Figure 1:
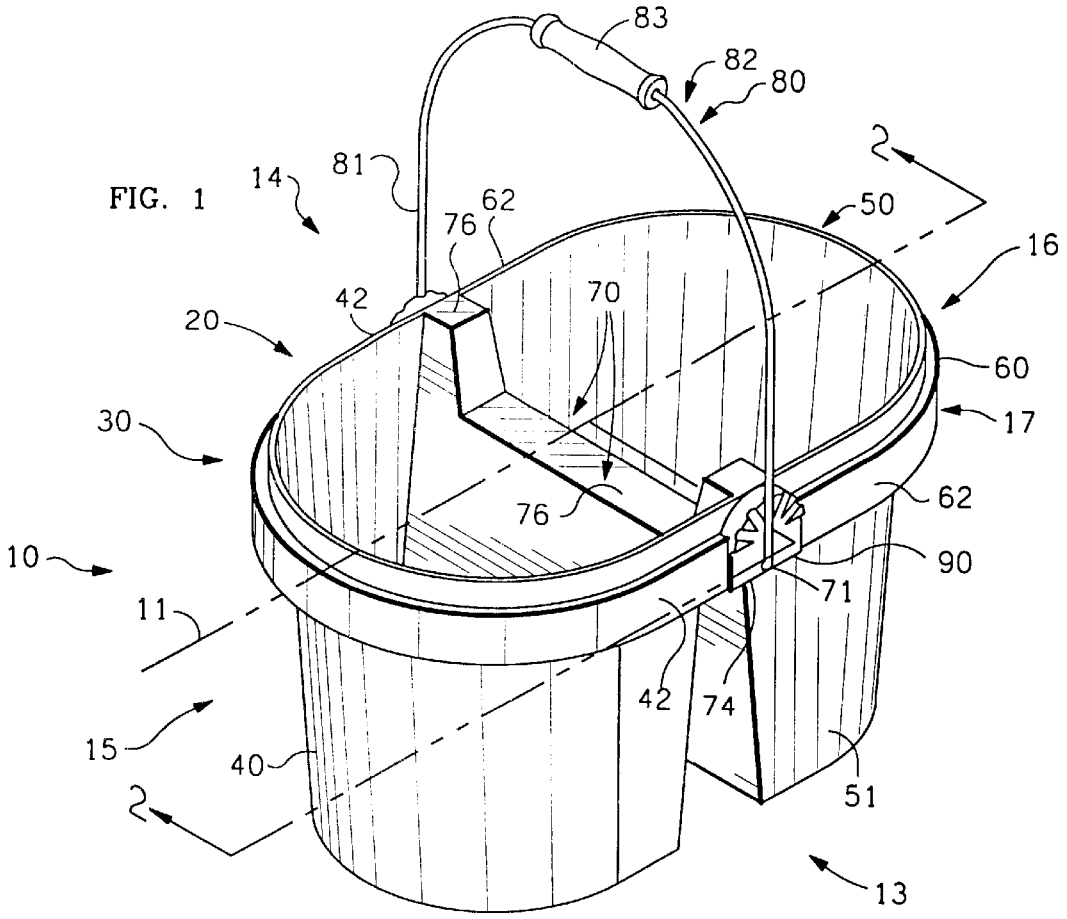
FIG. 1 is a perspective view of a preferred embodiment of the dual bucket assembly of the invention.

With reference now to the drawings, FIG. 1 is a perspective view of a preferred embodiment of the dual bucket assembly 10 of the invention. The dual bucket assembly 10 generally comprises a dual bucket 20 including a first container 30 adapted for holding liquid, a second container 50 adapted for holding liquid, connecting means, such as connecting member 70, rigidly connecting containers 30, 50 in a spaced apart relationship, a bail 80, and leveling means, such as detent mechanism 90, for detaining bail 80 in a desired position. FIG. 1 also shows a circumferential reinforced drip rim 17 encircling dual bucket 20. Dual bucket 20 and its various components can be integrally constructed of injection molded plastic, fiberglass, acrylic, or other similar material commonly used in pail construction and as is well-known in that art.

A longitudinal axis 11 runs through both containers 30, 50 such that a front side 13 of dual bucket 20 is located to one side of longitudinal axis 11 and a back side 14 of dual bucket 20 is located to the opposite side of longitudinal axis 11. Container ends, denoted generally as 15, 16, are preferably curved as shown in FIG. 1.

Figure 2:
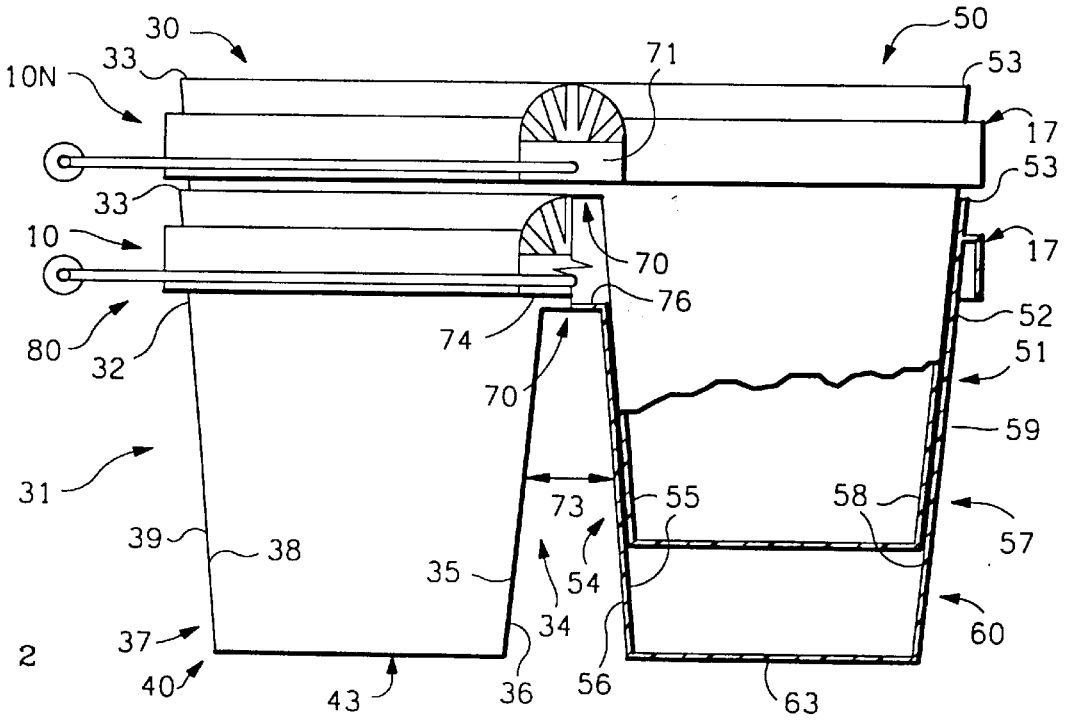
FIG. 2 is a front elevational view and partial vertical cross-section taken on the line 2—2 of FIG. 1 and further showing an additional dual bucket assembly in a nested arrangement.

Looking also at FIG. 2, there is shown a front elevational view and partial vertical cross-section taken on the line 2—2 of FIG. 1. FIG. 2 also includes an additional dual bucket assembly 10N in a nested arrangement.

Referring to FIGS. 1 and 2, various elements of first container 30 are shown including: a peripheral wall, denoted generally as 31, having an upper end 32 having a top edge 33; a bottom 43; a proximal portion 34 of peripheral wall 31 adjacent second container 50; and a non-proximal portion 37 of peripheral wall 31 having side walls 42 and a curved end wall 40. The corresponding elements of second container 50 are also shown: a peripheral wall, denoted generally as 51, having an upper end 52 having a top edge 53; a bottom 63; a proximal portion 54 of peripheral wall 51 adjacent first container 30; and a non-proximal portion 57 of peripheral wall 51 having side walls 62 and a curved end wall 60.

Dual bucket 20 is adapted for stacking a plurality of dual bucket assemblies 10 in a nested arrangement, as shown in FIG. 2. Peripheral walls 31, 51 are downwardly inwardly sloping making the lower portions of containers 30, 50 narrower than the upper portions near upper ends 32, 52. Connecting member 70 attached to upper ends 32, 52 of peripheral walls 31, 51 rigidly connects containers 30, 50 in a spaced apart relationship. As best seen in FIG. 2, the space, denoted generally as 73, between proximal portions 34, 54 as well as the downward, inward taper of containers 30, 50 facilitates storage of multiple dual buckets in a nested arrangement by allowing one dual bucket 20 to be nested within another dual bucket 20 to at least half, and preferably to 75% or more, of the depth of containers 30, 50. FIG. 2 shows dual bucket assembly 10N nested within dual bucket 10 substantially until connecting member 70 or reinforced drip rim 17 are encountered. Nesting is desirable because it minimizes the space required to store and transport a plurality of dual bucket assemblies 10.

Figure 5:
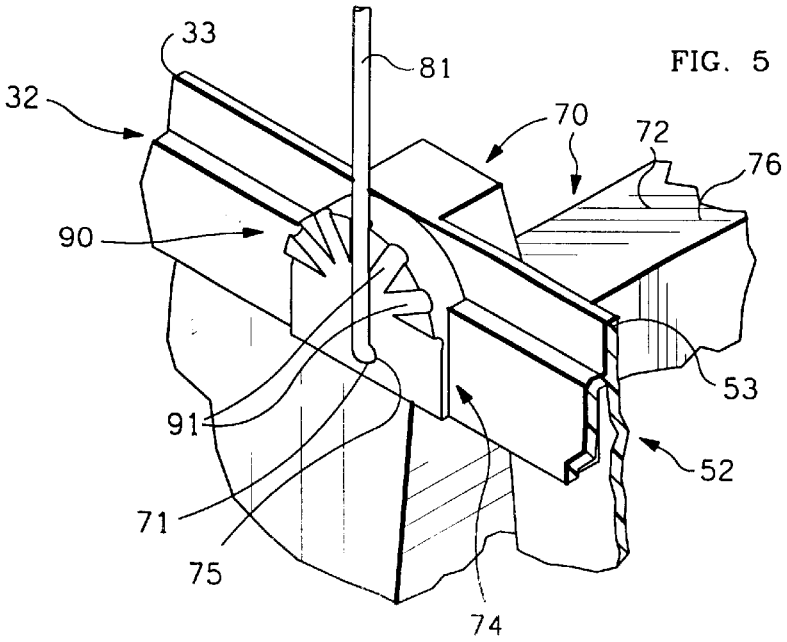
FIG. 5 is an enlarged cut-away perspective view of the leveling means of FIG. 4.

Further including FIGS. 3–5, FIG. 3 is a top plan view of the dual bucket assembly 10 of FIG. 1 further showing a paint roller 100 comprising a roller 101 and a handle 102. FIG. 4 is a front elevation view of the assembly of FIG. 1 further including a paint roller and grid and showing a preferred embodiment of the leveling means of the invention in use. FIG. 5 is an enlarged cut-away perspective view of the leveling means of FIG. 4.

Connecting member 70, connecting upper ends 32, 52 of containers 30, 50, spans the distance 73 between proximal portions 34, 54 and holds containers 30,50 in relative fixed position. Connecting member 70 includes horizontal members 76 and vertical members 78 which form a rigid connecting structure. A vertical component 74 of connecting member 70 may be integral with reinforced drip rim 17 and contain bail attachment mechanism 71, such as hole 75 for receiving proximal end 81 of bail 80. In the preferred embodiment shown in FIGS. 1–3, connecting member 70 has a central recess 72 between front side 13 and back side 14 of dual bucket 20 having a depth to approximately the bottom of drip rim 17. As shown in FIG. 4, recess 72 allows handles of paint rollers or other similar tools to easily pass under bail 80 to be in a position for easy access from either side of bail 80. Recess 72 is preferably limited in depth to less than 20% of the over-all depth of containers 30, 50. Recessed horizontal member 76 also contributes to the stiffness and strength of connecting member 70.

Looking more closely at FIG. 3, the preferred embodiments of proximal portions 34, 54 and non-proximal portions 37, 57 of peripheral walls 31, 51 are shown. With respect to peripheral wall 31 of first container 30, the inside face 38 of non-proximal portion 37 is indicated, as is the inside face 35 of proximal portion 34. The corresponding inside face 58 of non-proximal portion 57 as well as the inside face 55 of proximal portion 54 are indicated with respect to peripheral wall 51 of second container 50.

In the preferred embodiment shown in FIG. 3, inside faces 35, 55 of proximal portions 34, 54 are substantially planar. When these surfaces meet the substantially planar bottoms 43, 63 of containers 30, 50, the intersection results in a substantially linear interior joint creating a substantially straight-walled interior section of each container 30, 50 such that roller 101 of paint roller 100 having a roller length approximately the maximum width of a container 30, 50 may be placed adjacent the bottom of a proximal portion 34, 54.

Non-proximal portions 37, 57 of peripheral walls 31, 51 are composed of curved end walls 40, 60 and substantially planar side walls 42, 62. Curved end walls 40, 60 are preferably smoothly arcuate at top edges 33, 53 such that a painter using dual bucket assembly 10 may wipe excess paint off of a paint brush at any point along top edges 33, 53. A radius of curvature, denoted generally as 41, 61 in FIG. 3, of greater than two (2) inches provides a broad wiping surface such that the bristles of a large paint brush remain in contact with inside faces 38, 58 of top edges 33, 53 irrespective of the wiping location along non-proximal portions 37, 57. By eliminating corners with small radii of curvature which can trap liquid contents, smoothly arcuate non-proximal portions 37, 57 thus help painters achieve even distribution of paint on brushes and also facilitate cleaning of containers 30, 50.

Figure 6:
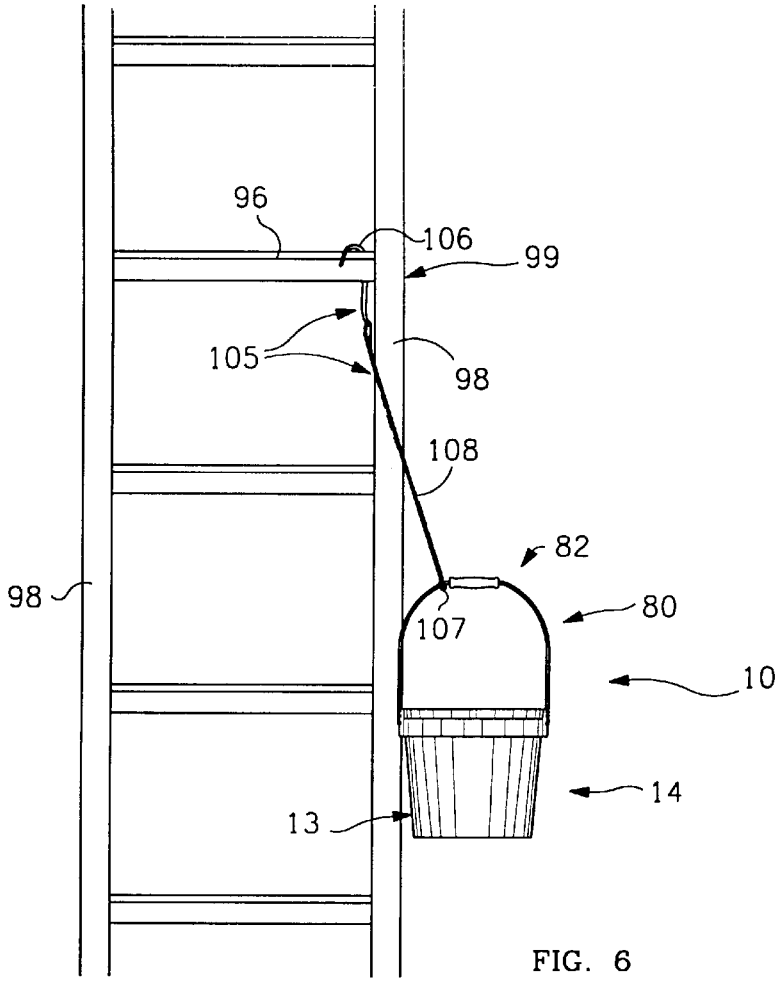
FIG. 6 is a view of the dual bucket assembly of the invention in use with a ladder.

Inside face 35 of proximal portion 34, inside face 38 of non-proximal portion 37, inside face 55 of proximal portion 54, and inside face 58 of non-proximal portion 57 are all preferably smooth so as not to create spaces where dried liquid can be trapped. Outside face 39 of non-proximal portion 37 and outside face 59 of non-proximal portion 57 preferably are substantially planar along side walls 42, 52, making front side 13 and back side 14 of dual bucket 20 substantially planar and parallel to longitudinal axis 11 for approximately the middle third of the over-all distance between ends 15, 16. As shown in FIG. 6, either of the resulting substantially planar surfaces on front side 13 or on back side 14 will rest flush against the side member 98 of a ladder 99, minimizing twisting of dual bucket assembly 10 when freely hung by bail 80.

FIG. 3 shows a top plan view of this preferred, substantially oval embodiment, where peripheral walls 31, 51 have curved end walls 40, 60 describing uniformly arcuate curves for wiping paint brushes or the like, as well as substantially parallel side walls 42, 62 creating substantially planar front 13 and back 14 sides against which dual bucket assembly 10 hangs flat when suspended by the bail 80.

FIG. 3 further shows bail 80 in the horizontal, stored position. Bail 80 has a distal end 82 and a proximal end 81 pivotally connected to connecting member 70 at bail attachment mechanism 71. In the preferred embodiment, bail 80 is attached at front side 13 and back side 14 of dual bucket 20 and is of sufficient length that it extends past peripheral walls 31, 51 such that it can be stowed in the horizontal position when a plurality of dual bucket assemblies 10 are stored in the nested arrangement. Bail 80 may be made of narrow gauge rigid metal wire, fiberglass, plastic or other material such as is common in ordinary water pails. Bail 80 may also be supplied with a carrying handle 83.

Figure 7:
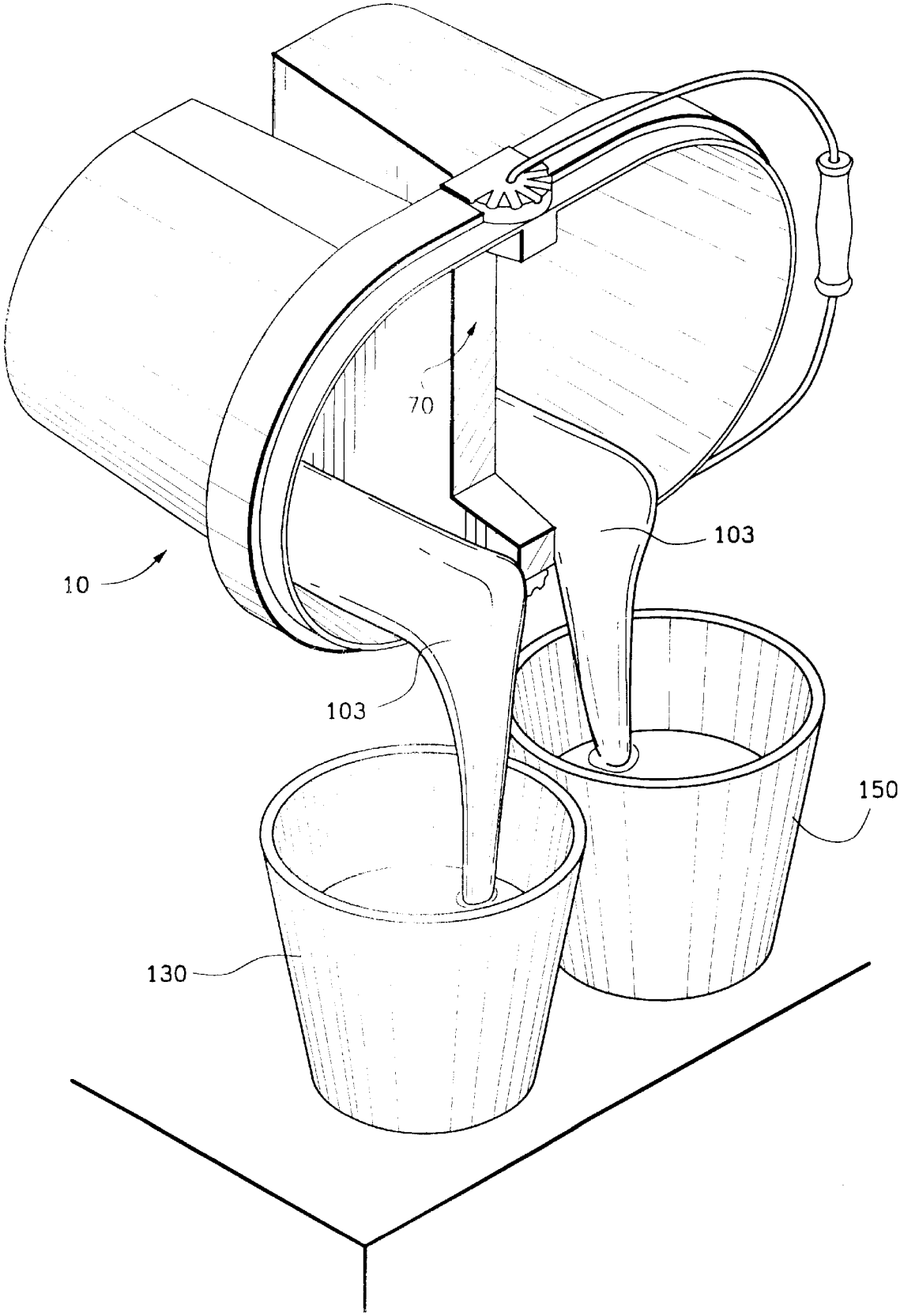
FIG. 7 is a perspective view of the dual bucket assembly pouring liquid simultaneously from both containers into separate receptacles.

It is often desirable for a user to pour the contents of one container 30 into one receptacle while simultaneously pouring the contents of the other container 50 into a different receptacle. FIG. 7 is a perspective view of the dual bucket assembly 10 pouring liquid 103 simultaneously from both containers 30, 50 into separate receptacles 130, 150. In the preferred embodiment, peripheral walls 31, 51 and connecting member 70 are adapted for pouring liquid contents of both containers 30, 50 simultaneously from either front side 13 or back side 14 of dual bucket 20. This separate pouring capacity is accomplished in the preferred embodiment in that connecting member 70 joins peripheral walls 31, 51 sufficiently proximal to top edges 33, 53 on at least one side of longitudinal axis 11 such that the contents of first container 30 remain isolated from the contents of second container 50 when the contents of both are poured simultaneously from that side of dual bucket 20 into separate receptacles 130, 150.

FIGS. 1 and 3 show connecting member 70 joining peripheral walls 31, 51 at top edges 33, 53 on both sides of longitudinal axis 11 to provide for error-free separate pouring from both front side 13 and back side 14 of dual bucket 20. In such an embodiment where connecting member 70 meets top edges 33, 53, the distance between connecting member 70 and distal end 82 of bail 80 is at a minimum.

Recess 72 in connecting member 70 greatly increases ease of use, since handle 102 of paint roller 100 or similar tool resting against proximal portions 34, 54 is lowered with respect to distal end 82 of bail 80. Recessed connecting member 70 increases the area under bail 80 in this instance, allowing the user to grasp tool handles from either side of bail 80, as shown in FIG. 4.

In use, dual bucket assembly 10 may be hung from distal end 82 of bail 80. If the contents of containers 30, 50 are not of equal weights such that the center of gravity 12 is not centered longitudinally, dual bucket 20 will hang at an awkward angle unsuitable for use. To correct an imbalance, distal end 82 of bail 80 can be secured substantially above center of gravity 12 of dual bucket assembly 10. This location of distal end 82 ensures that dual bucket assembly 10 as a whole will remain level when suspended by bail 80. Leveling means attached to dual bucket 20 allows the user of dual bucket assembly 10 selectively to secure proximal end 81 of bail 80 such that the position of distal end 82 of bail 80 is maintained substantially above center of gravity 12 when the assembly 10 is freely hung from bail 80.

FIG. 4 is a front elevation view showing a preferred embodiment of leveling means, such as detent mechanism 90, of the invention in use. Also shown in FIG. 4 is a paint roller grid 103 and a paint roller 100 with roller 101 and handle 102. Referring also to FIG. 5, an enlarged cut-away perspective view of detent mechanism 90 is shown. In the preferred embodiment of detent mechanism 90, bail attachment site 71 is fixed longitudinally but bail 80 is pivotally mounted. Detent mechanism 90 detains proximal end 81 of bail 80 such that the angle of bail 80 relative to vertical is selectively lockable. This detention may be accomplished by selectively engaging bail proximal end 81 into one of a plurality of detention slots 91 oriented at varying angles from vertical and adapted for receiving and detaining the proximal end 81 of the bail 80. Detention slots 91 may be of the tongue and groove variety where the slot aperture is slightly smaller than the diameter of bail 80, thus clipping proximal end 81, once properly seated, in place.

Other embodiments of the leveling means are contemplated. For example, another embodiment of leveling means, not shown, comprises a sliding attachment for bail 80, wherein the entire leveling means slides longitudinally along the front side 13 and back side 14 of dual bucket 20. In such an embodiment, the attachment point of bail 80 can be shifted longitudinally such that a vertical line can be described through bail distal end 82, bail proximal end 81, and center of gravity 12 of dual bucket assembly 10.

FIG. 6 is a view, looking along longitudinal axis 11, of the dual bucket assembly 10 of the invention in use. A hanging tether 105 comprises a first hook 106 and a second hook 107 joined by a flexible tension member such as a chain or a rope 108. First hook 106 is attached to a rung 96 of ladder 99, and second hook 107 is attached to bail distal end 82. The substantially planar front side 13 of dual bucket assembly 10 rests flush against the side member 98 of ladder 99, thereby minimizing unwanted twisting and movement of the hanging assembly 10.

Having described the invention, it can be seen that it provides a very convenient device for painting and other work. The assembly can simultaneously accommodate a large combination of tools. Hands and tools are kept clean during use because brushes and rollers do not have to pass over each other when switching tools. Two different types of liquid, such as two paint types or colors or wet stucco and water, are easily accessible at one time. The dual bucket hangs substantially level even when the center of gravity is off center. The planar facing walls provide maximum carrying capacity for a given length.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

Having thus described my invention, I claim:

1. A dual bucket assembly comprising:

a dual bucket comprising:

a first container adapted for holding liquid; said first container including:

a peripheral wall having an upper end having a top edge; said peripheral wall including:

a proximal portion adjacent a second container; said proximal portion having:

an inner face; and an outer face; and a non-proximal portion having:

an inner face; and an outer face; and said second container adapted for holding liquid; said second container including:

a peripheral wall having an upper end having a top edge; said peripheral wall of said second container including:

a proximal portion adjacent said first container; said proximal portion of said second container having:

an inner face; and an outer face; and a non-proximal portion having:

an inner face; and an outer face; and connecting means attached to said upper ends of said peripheral walls rigidly connecting in a spaced apart relationship said upper end of said peripheral wall of said first container and said upper end of said peripheral wall of said second container;

said dual bucket having a longitudinal axis through both of said containers, a front side to one side of said longitudinal axis, and a back side to the opposite side of said longitudinal axis; said peripheral walls being downwardly inwardly sloping such that a plurality of said dual buckets are nestable; and wherein said peripheral walls and said connecting means are adapted for simultaneously pouring liquid contents of both of said containers from a said side of said dual bucket such that liquid contents of said first container remain isolated from liquid contents of said second container when both contents are poured simultaneously from a said side of said dual bucket.

2. The dual bucket assembly of claim 1 wherein said proximal portions of said peripheral walls are substantially planar.

3. The dual bucket assembly of claim 1 wherein said top edge of each said non-proximal portion of said peripheral walls is smoothly arcuate.

4. The dual bucket assembly of claim 3 wherein the radius of curvature of each said non-proximal portion of said peripheral walls is greater than two (2) inches.

5. The dual bucket assembly of claim 1 wherein each said non-proximal wall portion comprises:

side walls; and a curved end wall;

such that said side walls and said end wall describe a smoothly arcuate inner face.

6. The dual bucket assembly of claim 1 wherein said connecting means joins said peripheral walls proximal said top edges of said peripheral walls on said pouring side.

7. The dual bucket assembly of claim 2 wherein said connecting means joins said peripheral walls at said top edges of said peripheral walls on said pouring side.

8. The dual bucket assembly of claim 1 wherein said dual bucket is adapted for stacking in a nested arrangement a plurality of said dual bucket assemblies such that one said dual bucket may be placed within another to at least ½ the depth of said containers.

9. A dual bucket assembly comprising:

a dual bucket comprising:

a first container adapted for holding liquid; said first container including:

a peripheral wall having an upper end having a top edge; said peripheral wall including:

a proximal portion adjacent a second container; said proximal portion having:

an inner face; and an outer face; and a non-proximal portion having:

an inner face; and an outer face;

said second container adapted for holding liquid; said second container including:

a peripheral wall having an upper end having a top edge; said peripheral wall of said second container including:

a proximal portion adjacent said first container; said proximal portion of said second container having:

an inner face; and an outer face; and a non-proximal portion having:

an inner face; and an outer face; and connecting means attached to said upper ends of said peripheral walls rigidly connecting in a spaced apart relationship said upper end of said peripheral wall of said first container and said upper end of said peripheral wall of said second container;

said dual bucket having a longitudinal axis through both of said containers, a front side to one side of said longitudinal axis, and a back side to the opposite side of said longitudinal axis; said peripheral walls being downwardly inwardly sloping such that a plurality of said dual buckets are nestable;

said peripheral walls and said connecting means being adapted for simultaneously pouring liquid contents of both of said containers from a said side of said dual bucket such that liquid contents of said first container remain isolated from liquid contents of said second container when both contents are poured simultaneously from a said side of said dual bucket; and a bail including:

a distal end; and a proximal end pivotally connected to said dual bucket; and leveling means attached to said dual bucket for selectively securing said proximal end of said bail such that the position of said distal end of said bail is selectively maintained substantially above the center of gravity of said dual bucket assembly when said assembly is freely hung from said distal end of said bail.

10. The dual bucket assembly of claim 9 wherein said leveling means comprises:

detention means for detaining said proximal end of said bail such that the angle of said bail relative to vertical is selectively lockable in a plurality of positions.

11. The dual bucket assembly of claim 10 wherein said detention means includes:

a plurality of bail detention slots oriented at varying angles from vertical adapted for selectively receiving and detaining said bail adjacent said proximal end.

12. The dual bucket assembly of claim 1 further including:

a bail including:

a distal end; and a proximal end pivotally connected to said dual bucket.

13. The dual bucket assembly of claim 1 wherein each said non-proximal wall portion comprises:

an end wall; and side walls; said side walls being substantially planar and parallel to the longitudinal axis for approximately the middle third of the over-all distance between ends.

14. The dual bucket assembly of claim 2 wherein each said non-proximal wall portion comprises:

an end wall; and side walls; said side walls being substantially planar and parallel to the longitudinal axis for approximately the middle third of the over-all distance between ends.

* * * * *